United States Patent [19]

Kuckes

[11] Patent Number: 5,074,365

[45] Date of Patent: Dec. 24, 1991

[54] BOREHOLE GUIDANCE SYSTEM HAVING TARGET WIRELINE

[75] Inventor: Arthur F. Kuckes, Ithaca, N.Y.

[73] Assignee: Vector Magnetics, Inc., Ithaca, N.Y.

[21] Appl. No.: 582,081

[22] Filed: Sep. 14, 1990

[51] Int. Cl.[5] ..... E21B 7/04; E21B 47/00; G01V 3/08

[52] U.S. Cl. ..... 175/40; 175/45; 175/61; 166/66.5; 324/346

[58] Field of Search ..... 175/40, 45, 61, 62; 166/250, 65.1, 66.5, 50; 324/346

[56] References Cited

U.S. PATENT DOCUMENTS

| | | | |
|---|---|---|---|
| 4,072,200 | 2/1978 | Morris et al. | 175/45 |
| 4,372,398 | 2/1983 | Kuckes | 324/346 |
| 4,396,075 | 8/1983 | Wood et al. | 166/50 |
| 4,465,140 | 8/1984 | Hoehn, Jr. | 324/346 |
| 4,529,939 | 7/1985 | Kuckes | 324/346 |
| 4,593,770 | 6/1986 | Hoehn | 175/45 |
| 4,685,515 | 8/1987 | Huang et al. | 166/50 |
| 4,700,142 | 10/1987 | Kuckes | 175/45 |
| 4,791,373 | 12/1988 | Kuckes | 324/346 |
| 4,933,640 | 6/1990 | Kuckes | 175/45 |

*Primary Examiner*—Bruce M. Kisliuk

*Attorney, Agent, or Firm*—Jones, Tullar & Cooper

[57] ABSTRACT

A method for guiding a borehole with respect to a target wireline carrying low frequency alternating current is disclosed. A wireline carrying an electrode at its terminal end is positioned in a target cased or uncased borehole with the electrode contact the wall of the borehole. An AC source is connected between the wireline and ground to supply current to the borehole wall near the bottom of the borehole. A sensor is positioned in a borehole being drilled to sense the magnetic field generated by current flow in the wireline, the sensor being spaced sufficiently far along the wireline from the electrode location to prevent magnetic fields due to return current through the target borehole casing on through the ground surrounding the target borehole from significantly affecting the sensor. The sensor measures the net alternating magnetic field to determine the direction to the target borehole, to permit guidance of the borehole drilling.

16 Claims, 2 Drawing Sheets

FIG. 1
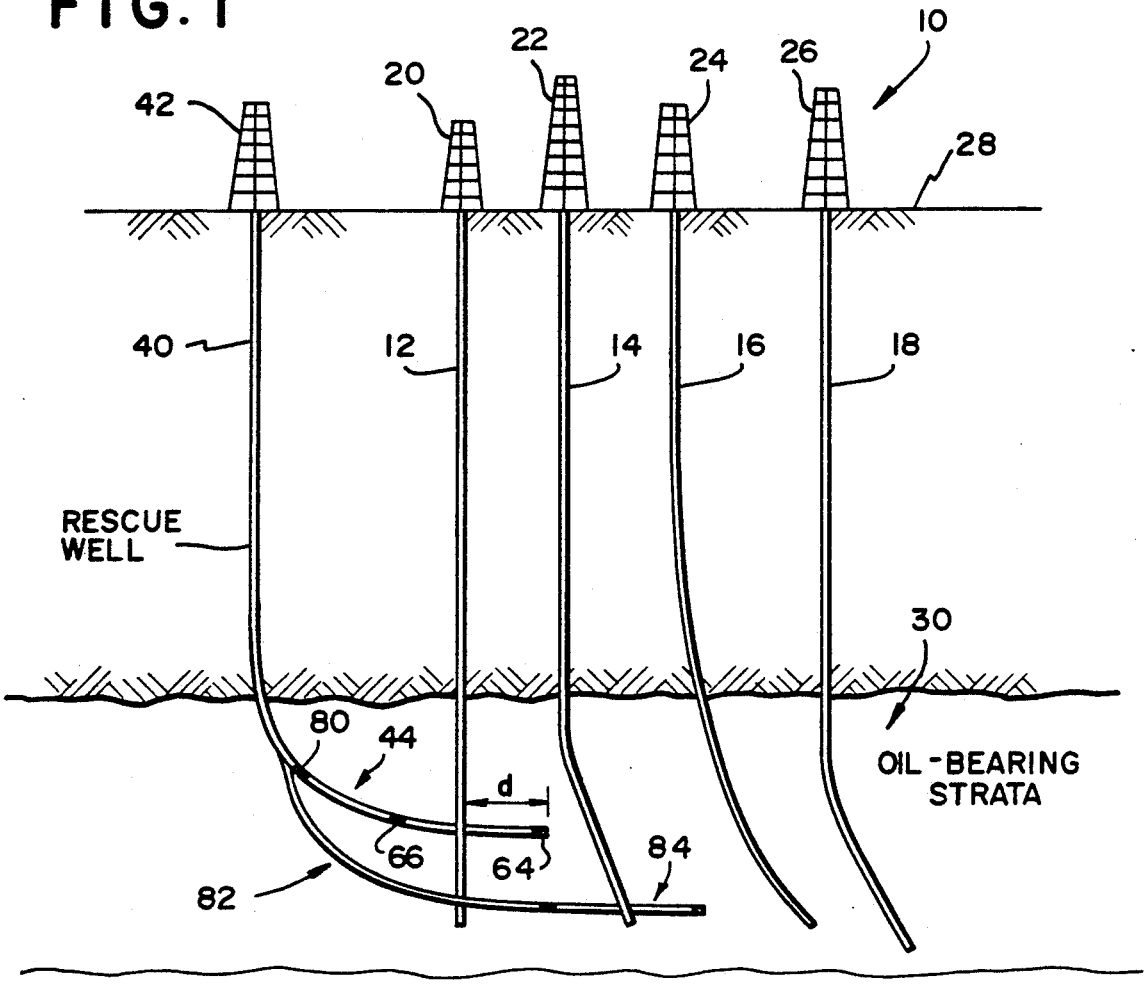
FIG. 2
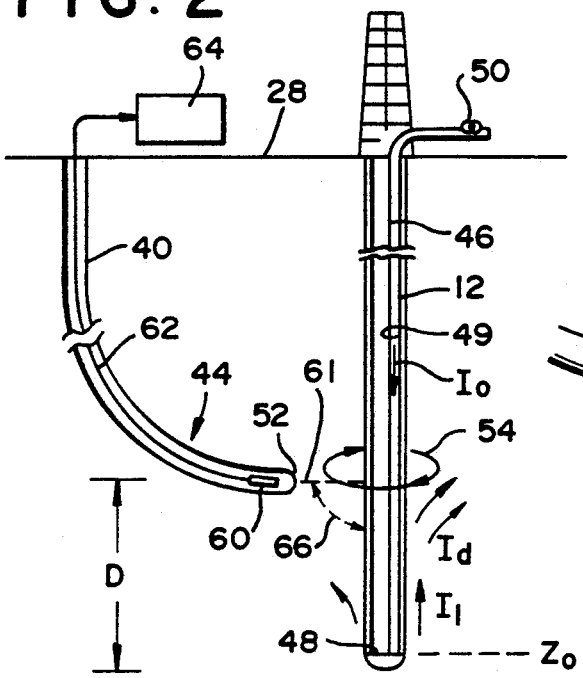
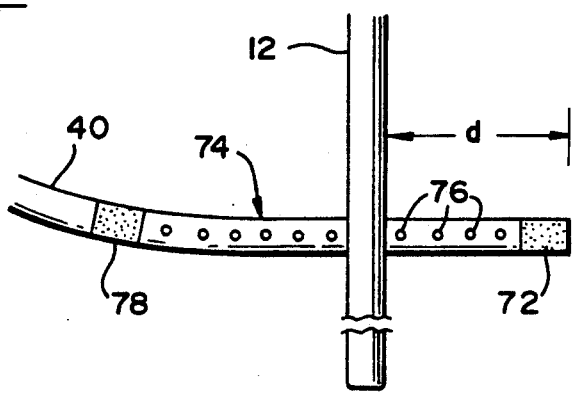
FIG. 6

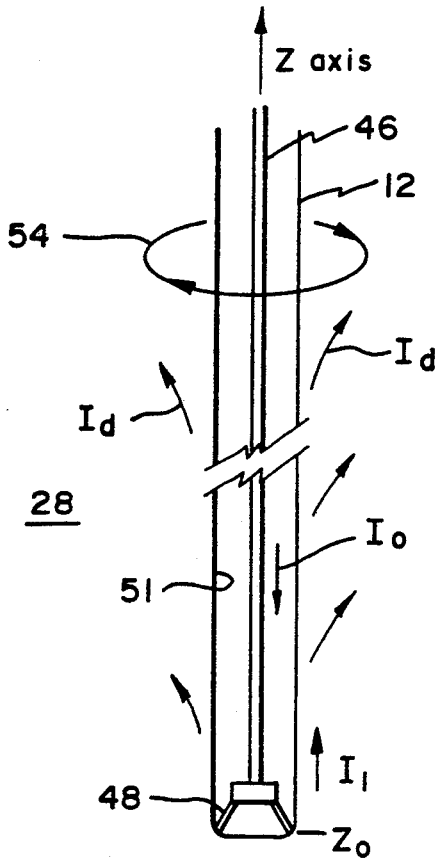
FIG. 3
FIG. 4
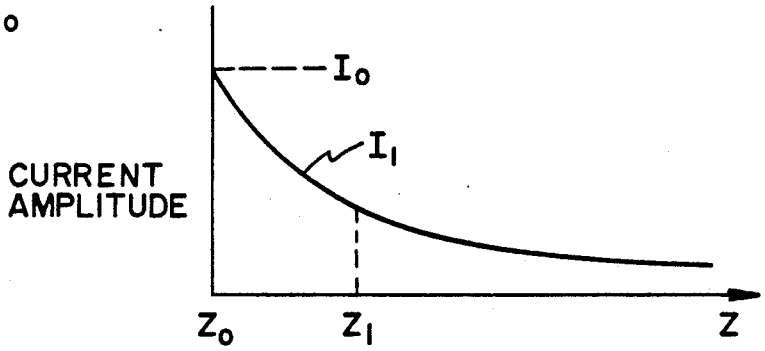
FIG. 5
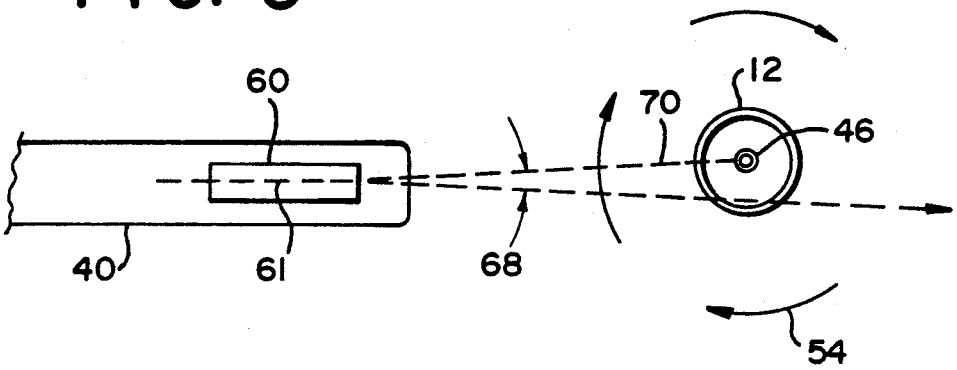

BOREHOLE GUIDANCE SYSTEM HAVING TARGET WIRELINE

The present invention relates, in general, to a system for guiding a borehole such as a rescue well, and more particularly, to a system for controlling the direction of drilling a borehole, which may be travelling in a horizontal direction, by means of a wireline in a target well.

BACKGROUND OF THE INVENTION

The magnetic fields produced by current flow in a target well are an extremely valuable tool in the guidance of drilling equipment, and a considerable amount of effort has been devoted to the development of techniques for producing such fields and to the development of highly sensitive equipment for accurately detecting them. The detection equipment may be located in a borehole being drilled, for example, to detect the distance and direction to an existing target well. This information is used to control the direction of drilling so that the borehole can be positioned with respect to the target to intercept it at a desired location, to avoid it, or to pass near it, as may be desired.

Such directional control systems may be used in drilling a new well in a field of existing wells where the existing wells are to be avoided, in drilling a rescue well to intersect an existing well which has blown out, in drilling horizontal collection boreholes adjacent existing wells, and in numerous other applications. For example, a producing oil field typically includes a large number of wells leading generally vertically from the surface of the earth downwardly into oil-bearing strata from which the crude oil is extracted. These wells often are quite close together, particularly when the wells originate at an offshore drilling platform and, as pointed out in U.S. Pat. No. 4,593,770 to Hoehn, the drilling of additional vertical wells within a field requires careful control of the drilling in order to avoid intersection with existing wells. In accordance with the Hoehn patent, such undesired intersections are avoided by lowering, as by means of a support cable, a wireline carrying a bore hole tool into each of the existing wells and injecting into the casings of such existing wells alternating currents which produce corresponding magnetic fields surrounding the existing well casings. A bore hole tool carries contact pads which incorporate electrodes for contacting the casing of the well in which the bore hole tool is located, so that current can flow downhole through the support cable and through the electrodes into the casing. In the Hoehn patent, each of the existing wells is injected with current of a different frequency so that specific wells can be identified by the frequency of their corresponding magnetic fields. A magnetometer in a non-magnetic section of a well being drilled can then measure the magnetic fields produced by the current flow in existing wells during drilling so that the well being drilled can be redirected as required. By the technique described in the '770 patent, a large number of wells can be drilled into an oil bearing field so as to maximize its production.

As a further example, when the oil contained in an oil-bearing field is gradually depleted by the producing wells, the flow of oil to the wells gradually slows, and eventually stops. Often, however, there remains a considerable amount of oil in the strata from which the oil is being drawn, even though the wells have stopped producing, and this remaining oil can be recovered by means of a "rescue" well which is drilled from the surface downwardly to the oil bearing strata. This rescue well is drilled vertically and is then curved to a horizontal attitude and must, in many cases, pass vertically near one or more existing vertical wells without inadvertently intersecting them, and then must pass horizontally through the well field, again without intersecting the producer wells. The horizontal run of the rescue well is guided not only to avoid intersection with the producer wells, but also to pass within about 2 meters of a selected target vertical producer well. The horizontal well passes the target producer and travels beyond it a predetermined distance, and is then sealed at its far end. The horizontal run is then perforated by a multiplicity of holes spaced along its length from its far, or terminal, end toward a near location which is a distance on the near side of the vertical producer well approximately equal to the distance of the far end from the producer well. After perforation, the horizontal section is sealed off at the near location to form a closed near end. This leaves a sealed-off, perforated, intermediate section which forms a right angle, or T, with respect to the target vertical producer well. This perforated section preferably is symmetrical with respect to the target well, and serves to collect oil from the oil bearing strata in the region of the target vertical producer well and to drain that collected oil toward the producer well.

When a system of collectors is to be provided, the rescue well is redrilled above the near-end plug and is again directed horizontally toward a second target producer well in the field. The horizontal rescue well is again drilled to pass near, but to avoid a direct intersection with, the second target vertical producer well and extends past that vertical well by a selected distance. The rescue well is again sealed at its far end, is perforated, and is sealed at a near location which is equidistant from the target vertical well to form a near end, thereby producing a second field-draining intermediate collector section which directs oil to the second target producer well. The rescue well may again be redrilled from the region of the near-end plug and the process repeated for a third and for subsequent target vertical producer wells.

Numerous other applications of borehole drilling techniques which require accurate control of the drilling of a borehole, or rescue well, through a field of existing target wells are known. In each it is critical to the success of the technique that reliable information about the relative locations of the rescue and target wells be available at the earliest possible time during the drilling.

A convenient directional control system for situations where the target wells are open; i.e., where access to the wells is available from the surface, is illustrated in the above-mentioned U.S. Pat. No. 4,593,770. In accordance with that patent, a wireline is dropped down a cased well, and its electrodes contact the casing at a selected depth to inject current. The point within each existing well at which current is injected is a point that is as close as possible to the likely intersection point between the existing well and the well being drilled. Current then flows from that point of injection both upwardly and downwardly in the casing to produce a resultant magnetic field in the earth surrounding the existing well. Because the point of current injection is selected to be at the projected point of intersection of the existing well and the well being drilled, the current flowing down the wireline divides after it is injected into the casing with one half flowing downwardly from the injection point, and one half flowing upwardly from that point toward the surface. The magnetic field produced by the upwardly flowing current in the casing surrounding the wireline is in direct opposition to and is equal to one-half of, the magnetic field produced by the downwardly flowing wireline current. As a result, the net magnetic field above the injection point is one half the magnetic field produced by the wireline current. The magnetic field below the injection point is also reduced by one half that of the wireline current, since only one half of the available current flows downwardly in the casing from that point. Accordingly, using this technique, only one half of the potentially available magnetic field is actually available for use in guiding the well being drilled.

SUMMARY OF THE INVENTION

In accordance with the present invention, accurate and reliable well drilling control information is provided by detecting at a rescue well an alternating magnetic field produced by current flow in a target well. The target alternating magnetic field is produced by lowering an insulated wireline conductor to the bottom of the selected target producer well. An electrode at the end of the wireline provides electrical contact with the bottom of the well. If the target well is cased, contact is preferably made at the bottom of the casing; if it is uncased, then contact is made with the earth at the bottom of the well, or at a relatively large distance below the anticipated point of intersection. Alternating current is applied between the wireline and the earth at the surface, whereby current flows down the wireline and through the electrode contact to the bottom of the casing or into the earth. A negligible amount of the current supplied by the wireline flows downwardly out of the bottom of the casing into the surrounding earth and is dissipated, but this current is so small it can be ignored. The remaining current flows upwardly from the electrode, either through the casing or through the earth surrounding the well. The current in the casing or injected into the earth by the electrodes is gradually dissipated into the surrounding earth, with the upward current flow in the casing or in the region of the well falling off exponentially with the axial distance Z from the injection point at $Z_O$, where the electrode contacts the casing or the earth. At a point $Z_1$, above the injection point, the current in the casing in the earth near the well will be 37% of its maximum value. The difference between the current which flows downwardly through the wireline and that which flows upwardly through the casing or the surrounding earth produces, at any point along the target well, a net, symmetrical magnetic field in a plane perpendicular to the axis of the target well, which field is horizontal and surrounds the axis of a vertical well. The net magnetic field above the location of point $Z_1$, where the counter-flowing current in the casing or in the earth near the well is minimal, is primarily due to current flow in the wireline. This provides a maximum intensity magnetic field for use in guiding the rescue well.

The net magnetic field produced by the AC current flow in the target well is detected in the rescue well by means of a magnetometer which determines the direction of the source of the magnetic field and provides output signals which may be used to guide the direction in which the rescue well is drilled. In a preferred form of the invention, the magnetometer has an axis of maximum sensitivity which is oriented horizontally and produces a null output when directed at a vertical current source for the magnetic field being detected. The output of the magnetometer is positive or negative when directed axially to one side or the other of the target. This directional measurement permits accurate guidance of the rescue drill, allowing it, for example, to pass close by a target well without intersecting it, so that it is possible to perforate and plug a collector segment of the rescue well.

The magnetometer used in the horizontal rescue well of the present invention may be similar to that utilized in U.S. Pat. No. 4,791,373 issued to the applicant herein, the disclosure of which is incorporated herein by reference. In that patent, a relief well is directed to intersect a target well utilizing a guidance system which incorporates a magnetometer for detecting the source of a magnetic field produced by a current flowing at the target. In that patent, however, the current flow is produced by means of an electrode located in the relief well, rather than in the target well. The electrode injects current into the earth surrounding the relief well, and a portion of that current is collected in the target well casing to produce around the casing a resulting magnetic field which is detectable by a magnetometer also located in the relief well. Such a method is extremely valuable in situations where there is no access to the target well, but has limitations in well avoidance drilling in an environment where there are multiple cased wells. This is because a ground-injected current tends to collect in the casings of all of the surrounding wells, thereby producing multiple magnetic fields which make the directional drilling of the rescue well very difficult. In accordance with the present invention, on the other hand, the target well is open, and may be either cased or uncased. Current flow is produced in wireline located in a single target well to facilitate accurate directional drilling with respect to that particular well. Furthermore, the current flow in the region of interest is essentially unidirectional since the return current flow is dissipated, so that a maximum intensity magnetic field is produced for improved guidance of a rescue well.

BRIEF DESCRIPTION OF THE DRAWINGS

The foregoing, and additional objects, features, and advantages of the present invention will become apparent from a consideration of the following detailed description of a preferred embodiment thereof, taken in conjunction with the accompanying drawings, in which:

FIG. 1 is a diagrammatic illustration of the overall system of the invention;

FIG. 2 is an enlarged view of a target well and an approaching rescue well., illustrating the magnetic fields generated at the target well;

FIG. 3 is an enlarged view of the terminal end of a target well illustrating the current flow from the casing into the surrounding strata;

FIG. 4 is a graph illustrating the amplitude of the current flow in the target well casing;

FIG. 5 is a top plan view of the target well and rescue well of FIG. 2; and

FIG. 6 is a partial view of a target well and completed drainage segment.

DESCRIPTION OF PREFERRED EMBODIMENTS

Turning now to a more detailed consideration of the present invention, one application of the invention is illustrated in FIG. 1, wherein an oil field 10 is shown to consist of a plurality of producer wells. Four such wells are shown at 12, 14, 16 and 18, With each being an open borehole, either cased or uncased, leading from corresponding surface structures 20, 22, 24 and 26, respectively, located at surface 28 of the earth. The producer wells lead generally vertically downwardly into oil bearing strata generally indicated at 30 for removal of crude oil located in the strata in the manner well known in the art. The oil field 10 may be a land-based field, consisting of any number of producer wells in the local area, or may be a plurality of wells leading from an off-shore drilling platform, again in conventional manner.

As is well known, as the oil in strata 30 is withdrawn, the production flow in the wells 12, 14, 16 and 18 gradually reduces until a point is reached at which no further oil can be withdrawn economically from the strata by the surface equipment. When this occurs, a wide variety of techniques, which have been developed over the years, are available to restore the flow of oil from the strata. Such techniques include, for example, injection of steam into the strata to heat and drive the oil out though the producer wells. In accordance with the present invention the flow of oil from the producer wells can be increased by means of collector segments positioned near the bottom of each of the producer wells within the oil-bearing strata. Such a collector segment is formed by drilling a horizontal rescue well having a borehole which passes very near to, but does not intersect, an existing target producer well. The borehole is perforated a part of along its length near the target well, and is then plugged to provide the collector segment. This segment extends horizontally in the oil bearing strata on both sides of the target producer well to collect oil from the strata and to allow that oil to drain into the producer well, thereby effectively increasing the width of the producer well near its bottom.

A collector segment is formed by drilling a rescue well such as that illustrated at 40 in FIG. 1 in the vicinity of the producer field 10. This rescue well is drilled from a conventional drilling rig 42 on the surface 28 of the earth or from a platform, and leads vertically downwardly toward the oil bearing strata 30. As the rescue well approaches the strata 30 it is curved toward the cluster of producer wells which make up the field 10, with the rescue well being curved until its trajectory becomes generally horizontal as indicated at 44 in FIG. 1. As the rescue well is drilled horizontally toward and through the producer well field, the rescue well must be guided carefully to ensure that it passes sufficiently near to a selected one of the producer wells to permit formation of a collector segment, while avoiding intersection with any producer well. This requires precise guidance with respect to the target well for which the collector segment is to be formed.

Guidance of the drilling of the rescue well 40 is carried out using a technique similar to that illustrated and described in the above-identified U.S. Pat. No. 4,791,373. In the aforesaid '373 patent, guidance is by means of a magnetic field which is produced by a low frequency alternating current injected into the earth from a relief well and collected at the I0 casing of a target well. However, such a technique is not suitable for the system of the present invention since multiple wells exist in the location of drilling, and current injection of the type used in the '373 patent would produce current flow and consequent magnetic fields surrounding each of the wells in the vicinity. Such multiple magnetic fields would prevent effective control of the directional drilling of the rescue well. Furthermore, such a technique is limited to target wells which incorporate a current conductor such as a casing or drill string, and is not effective for open, uncased holes.

In accordance with the present invention, the rescue well is to be drilled to pass near (or to intersect, if desired) a specific, preselected target well, and directional control is obtained by measuring the magnetic field produced by causing a low frequency alternating current to flow only in the target well. This field is produced, as illustrated in FIG. 2, by lowering into the open target well a wireline 46 which is insulated, and which carries at its lower end an electrode 48. The wireline 46 is lowered so that the electrode 48 contacts the bottom of the steel casing 49 contained in a cased target well or until it contacts the bottom of an uncased well. The upper end of the wireline is connected to one side of a source 50 of alternating current having a low frequency, preferably between 1 and 30 Hz. The other side of the source is connected to ground, as at the casing 49 of well 12. Energization of the source 50 causes a current $I_O$ to flow downwardly in the wireline 46 to electrode 48 where it is injected into the casing 49 of well 12. If the target well is uncased, as illustrated in FIG. 3, the electrode 48 contacts the wall 51 of the well 12, preferably at or near the bottom of the well.

The injected current $I_1$ flowing upwardly in a cased target well initially flows primarily in the casing 49 and is equal to $I_O$, but since the casing is in contact with the surrounding earth, the current $I_1$ is gradually dissipated outwardly, as indicated by the arrows $I_d$. The contact point between the electrode and the casing is identified in FIG. 2 as point $Z_O$ along the vertical, or Z, axis of the target well 12, and as illustrated in FIG. 4. The upward current flow $I_1$ at that point is at a maximum which is $I_O$. As the current flows upwardly and is dissipated into the surrounding earth 28, $I_1$ decreases exponentially with the axial distance Z, as indicated by the curve $I_1$ of FIG. 4. At any given distance Z above the contact point $Z_O$, the current $I_1$ in the casing is given by $$I_1 \approx I_O e^{-Z/Z_1} \qquad \text{Eq. 1}$$

where $$Z_1 \approx \sqrt{\frac{\ln Z_1/a}{2\pi\sigma R}} \qquad \text{Eq. 2}$$

and where R is the resistance per unit length of the casing, $\sigma$ is the conductivity of the earth surrounding the casing, and a is I0 the radius of the casing. The total, or net current I at any point along the casing is the difference between the down-flowing current $I_O$ and the up-flowing current $I_1$.

In an uncased well, the applied current $I_O$ is injected at $Z_O$ into the earth and tends to flow generally upwardly around the borehole 12, as indicated at $I_1$ in FIG. 3. The current $I_1$ near the well dissipates exponentially, as illustrated by current $I_d$ in FIG. 3 and as shown by the graph of FIG. 4. The current $I_1$ opposes the applied current $I_O$ so that for an uncased well the net current is the difference between the two, as is true for a cased well.

The net current in the target well produces a magnetic field 54 which is perpendicular to the axis Z of vertical borehole 12. The current which is dissipated into the earth flows in all directions from the target well, and to the extent that the dissipated current is uniform in all directions, produces no net magnetic field. The net magnetic field in a plane perpendicular to the target well has a value which can be calculated by noting the difference between the wireline and casing currents. At a distance Z above the electrode which is much greater than r:

$$H \approx \frac{I_0}{2\pi r} - \frac{I_1}{2\pi r} \qquad \text{(Eq. 3)}$$

where H is the magnetic field strength, and r is the radial distance from the casing.

At a distance z above the contact point of electrode 48, the magnetic field strength is:

$$H_{het} \approx \frac{I_0}{2\pi r} - \frac{I_e - Z/Z_1}{2\pi r} \qquad \text{(Eq. 4)}$$

As illustrated in equation 4, the net magnetic field is equal to the difference between the current flow in the wireline and the current flow in the casing (or in the immediate region of the borehole in an uncased well).

The rescue well 40 is drilled at a selected distance D above the bottom of the target well, which preferably is equal to or greater than the distance $Z_1$ (see FIG. 4), where the current $I_1$ flowing upwardly in the casing 12 or in the earth around the well has dissipated to about 37% or less of its maximum value. At this level, the magnetic field due to the wireline current $I_O$ dominates the counter field due to the casing current $I_1$, so that the net field 54 is of sufficient strength to provide accurate and reliable guidance for the rescue well at a significantly greater distance from the target well than was available with prior detection systems.

The magnitude of the current $I_1$ is an inverse function of the resistance R of the casing. If there is no casing, the resistance of the earth in the region of the well adjacent electrode 48 approaches infinity, and very little current flows along the borehole surface. The point Z at which the current reaches 37% of the maximum value is, therefore, much closer to the contact point of the electrode for an uncased well than for a cased well. Above the point $Z_1$ the magnetic field due to current in the wireline predominates in either a cased or an uncased well, so long as the control measurements are made at a point about $Z_1$, the existence or absence of a casing is immaterial.

Tests have shown that if the anticipated point of intersection of the rescue well with the target well is above the point where the target well current is less than about 37% of its maximum value, the system of the invention works well. Further, the system has been found to work well even when the current is greater than the 37% value.

The measurement of magnetic field 54 is accomplished, as described in the aforesaid '373 patent, by means of a magnetic field sensor 60. This sensor preferably is a fluxgate magnetometer having a ring core and a toroidal excitation winding surrounding the core and coaxial therewith. The axis of the toroid is perpendicular to the plane of the ring core, and is the axis of maximum sensitivity 61 of sensor 60. The ring core and the excitation winding are, in turn, surrounded by a sensor coil, in known manner, with the axis of the sensor coil perpendicular to the axis 61 of the ring core. When the field sensor 60 is horizontal, i.e., when the axis 61 of the ring core is horizontal, as when the sensor is in the generally horizontally extending portion 44 of the rescue well 40, this axis of maximum sensitivity 61 of the sensor 60 will also be horizontal. In this position, the sensor 60 is capable of accurately measuring the horizontal magnetic field 54 since it measures the component along its axis of any magnetic field to which it is exposed. The sensor 60 may be supported in the rescue well 40 by means of a wireline 62 which extends to the surface of the earth 28 for connection to suitable sensing equipment 64 as described in the '373 patent, or may be part of the drill stem assembly for measurement while drilling. If desired, an alternative sensor such as that shown in U.S. Pat. No. 4,372,398 may be used.

As the rescue well is drilled downwardly into the oil-bearing strata and is then curved, as at 44, toward a selected target well, conventional well logging techniques are used for guidance until the rescue well reaches a location within about 150 to 200 feet of the target well. The rescue well approaches the vertical target well generally horizontally so that it has an angle of approach 66 of approximately 90 degrees. An alternating current at a relatively low frequency is supplied to the wireline 46 in the target well 12 to produce the current flow described above and the resulting alternating magnetic field 54. This magnetic field is detected by the sensor 60 to provide an indication of the direction from the rescue well to the target well.

If the path of the rescue well 40, which is the same as the direction of axis 61, is such that it will intersect the target (see FIG. 5) then the magnetic field 54 at the sensor will be perpendicular to the sensor's axis of maximum sensitivity 61 and the sensor will produce a null reading; i.e., no output. If the path of the rescue well is non-intersecting, as by an angle 68 between the direction of the rescue well and the direction to the target, so that a continuation of the rescue well would pass by the target to one side or the other, then the magnetic field 54 in the vicinity of the sensor 60 will not be perpendicular to the axis of sensor 60, but will have a component which is parallel to !he axis 61 of maximum sensitivity of the sensor. This component will produce a corresponding output signal on wireline 62 which allows an accurate calculation of the angle 68 between the direction being followed by the rescue well (and thus the direction of the axis 61 of the sensor) and the actual direction of the target well location indicated at 70 in FIG. 5. The magnitude of this angle 68 provides the driller with the information required to change the direction of the rescue well 40 so it passes near, but does not intersect, the target well, or so that it intersects the well, as required.

Since the value of the current in the wireline in the target well is known, the magnitude of the magnetic field 54 produced by that current at any distance r from the wireline 46 may be calculated. By comparing the calculated values to the measured value, the distance between the sensor 60 and the target well 12 can be calculated. The angle between the axis 61 of the sensor and the direction 70 to the target well is determined by the phase relationship between the measured magnetic field and the current in the target well and by the ratio of the axial and perpendicular components of the field with respect to the hole being drilled. When the rescue well deviates to one side of the target well the measured magnetic field is 180 degrees out of phase with its value when the rescue well deviates toward the other side of the target. Thus, the sign of this information can be used by the driller to direct the rescue well to the right or to the left as it approaches the target, to enable the rescue well to pass the target without intersecting it, or to intersect it, if that should be desired.

Once the rescue well has passed by the target well, drilling continues for a predetermined distance such as the distance "d" illustrated in FIGS. 1 and 6. This distance may, for example, be 100 meters, although it may vary depending upon the nature of the oil bearing strata. The terminal end of the rescue well, on the far side of the producer well, may be plugged, as indicated by the cement plug 72 in FIG. 6, and the drill is withdrawn. It should be noted, however, that plugging at the terminal end usually is not required. An intermediate segment 74 of the rescue well may then be perforated, as illustrated by perforations 76 in FIG. 6 and a plug 78 is placed in the rescue well a similar distance d from the target well, but on the near side of the target, as illustrated, to thereby complete the collection segment 74 generally indicated in FIG. 6. This collection segment serves to collect oil from the bearing strata 30 in the region of the producer well 12, thereby permitting a further drainage of the strata. Segment 74 preferably is located near the bottom of the oil bearing strata, and near the bottom of its corresponding the producer well 12, but may be positioned in any desired location. For maximum sensitivity for the directional magnetometer however, this location is above the point $Z_1$, at which the current level in the casing has dropped to $\Delta$ the value of the maximum casing current $I_O$ flow, or even less.

Once the collection segment 74 is in place, the rescue well 40 may be redirected, for example by means of a diverting plug 80 further up the rescue well which allows the well 40 to be redirected along a second trajectory, generally indicated at 82. This allows the rescue well to be redirected to a second one of the producer wells in the field 10; for example, to producer well 14, and following the same technique, a horizontal collection segment generally indicated at 84 may be formed at the bottom of producer well 14. In similar manner, the rescue well can be plugged and again diverted for third and subsequent drainage segments for the remaining producer wells in the field 10 so that a collection segment is provided for each well in turn.

Although the horizontal rescue well has been described in terms of the technique for producing individual collection segments for each of a plurality of producer wells in oil bearing strata, the rescue well may also be used for other purposes, if desired. For example, the horizontal bore hole can function as an observation well to permit evaluation for the effectiveness of steam injection techniques, or the like, for increasing the production of the strata. Such an observation well would be drilled, and following the same general method of locating individual target wells in the field and controlling the direction of drilling, as described above, a plurality of vertical wells may be drilled in the vicinity of the horizontal well. In that case, the AC current is injected into the horizontal well, and magnetometers in the vertical wells are used to guide the vertical wells. Other uses of the herein disclosed techniques include the controlled drilling of geothermal wells which are located close to one another, and the mining of coal, wherein adjacent boreholes are to be drilled. In addition, this technique can be used in the "freeze and drill" method of tunneling through mud, wherein the mud is frozen and parallel holes are drilled in the ice close to each other to produce a large hole, with the walls of the hole being supported by the ice.

Although the present invention has been described in terms of a preferred embodiment, it will be apparent that numerous modifications and variations may be made without departing from the true spirit and scope thereof as set forth in the following claims.

What is claimed is:

1. A method for producing drainage well segments adjacent lower ends of corresponding individual producer wells in an oil well field incorporating a plurality of producer wells, comprising:

a) partially drilling a rescue well in a region adjacent a field of producer wells;

b) selecting a target producer well within the field of producer wells;

c) lowering into said target producer well a wireline carrying an electrode to contact a bottom portion of the target well;

d) supplying a low-frequency alternating current through said wireline to said electrode, said current flowing into the target well to thereby produce an alternating magnetic field surrounding the target well;

e) lowering into the rescue well a magnetic field sensor having an axis of maximum sensitivity;

f) aligning the axis of said magnetic field sensor within the axis of the rescue well near the end thereof to measure the component of said alternating magnetic field which is parallel to the axis of said sensor;

g) determining from the measured component of said alternating field the direction from the rescue well to the target well;

h) controlling the direction of further drilling of the rescue well in accordance with the determined direction to said target well to cause said rescue well to closely pass said target well without intersection;

i) drilling said rescue well to a predetermined distance past said target well; and j) segmenting an end portion of said rescue well to provide supplemental drainage of said oil bearing strata for said target producer well.

2. The method of claim 1, further including plugging said rescue well and partially redrilling the rescue well toward a second target producer well in said field;

providing in said second target producer well a wireline carrying an electrode to contact a bottom portion of the second target well;

supplying said low-frequency alternating current through the wireline in said second target well to produce a second target well alternating frequency magnetic field;

lowering said magnetic field sensor into said rescue well and repeating steps e-j to provide supplemental drainage of said oil bearing strata for said second target producer well.

3. The method of claim 1, wherein the step of segmenting the end portion of said rescue well comprises plugging said rescue well to isolate said end portion of said rescue well from the remainder of the rescue well; and perforating the segment of said rescue well between the plug and the terminal end of the rescue well.

4. A method for guiding a borehole being drilled with respect to an existing cased target borehole, comprising:

partially drilling a borehole in the region of a target borehole;

positioning an electrode in the target borehole in electrical contact with the terminal end of the target borehole casing;

supplying low frequency alternating current through a wireline in said target borehole to said electrode to produce a supply current flow $I_O$ in said wireline and through said electrode to said casing to produce a casing current flow $I_1$ in the target borehole casing, the supply current $I_O$ and the casing current $I_1$ flowing in opposite directions in said target borehole to produce a net alternating magnetic field surrounding the target borehole;

positioning in the borehole being drilled a magnetic field sensor having an axis of maximum sensitivity;

measuring the component of said resultant alternating magnetic field which is parallel to the axis of said sensor; and determining from the measured component of said net magnetic field the direction of the target borehole with respect to the axis of the borehole being drilled.

5. The method of claim 4, further including drilling said borehole in a direction generally perpendicular to a plane passing through the axis of said target borehole

6. The method of claim 5, further including guiding the drilling of said borehole in accordance with the determined direction of said target borehole.

7. The method of claim 5, further including drilling said borehole in a region of said target borehole wherein the casing current I is substantially less than the wireline current $I_O$, whereby said net magnetic field is primarily due to said wireline current.

8. The method of claim 7, wherein said borehole is drilled in a region of said target borehole wherein the magnitude of said casing current $I_1$ is less than about 37% of the magnitude of said wireline current $I_O$.

9. The method of claim 4, further including dissipating the casing current $I_1$ into the ground surrounding the target borehole in the region of the terminal end of the casing substantially equally in all directions, whereby the casing current diminishes, exponentially with axial distance above said electrode so that the casing current does not affect the net magnetic field around the target borehole at the location of the borehole being drilled.

10. The method of claim 4, further including dissipating the casing current $I_1$ into the ground surrounding the target borehole casing as the casing current flows away from the terminal end of the casing, whereby the magnitude of the casing current decreases exponentially with distance from the casing terminal end.

11. A method for guiding a borehole being drilled with respect to an existing target borehole, comprising:

partially drilling a borehole in the region of a target uncased borehole;

positioning an electrode in the target borehole in electrical contact with the target borehole near the terminal end thereof;

supplying low frequency alternating current through a wireline in said target borehole to said electrode to produce a supply current flow $I_O$ in said wireline and through said electrode and a ground current $I_1$ in the earth surrounding the target borehole to produce a net alternating magnetic field surrounding the target borehole;

positioning in the borehole being drilled a magnetic field sensor having an axis of maximum sensitivity;

measuring the component of said net alternating magnetic field which is parallel to the axis of said sensor; and determining from the measured component of said net magnetic field the direction of the target borehole with respect to the axis of the borehole being drilled

12. The method of claim 11, further including drilling said borehole in a direction generally perpendicular to a plane passing through the axis of said target borehole.

13. The method of claim 12, further including guiding the drilling of said borehole in accordance with the determined direction of said target borehole.

14. The method of claim 12, further including drilling said borehole in a region of said target borehole wherein the casing current $I_1$ is substantially less than the wireline current $I_O$, whereby said net magnetic field is primarily due to said wireline current.

15. The method of claim 14, wherein said borehole is dulled in a region of said target borehole wherein the magnitude of said ground current $I_1$ is less than about 37% of the magnitude of said wireline current $I_O$.

16. The method of claim 11, further including dissipating the current $I_1$ into the ground surrounding the target borehole as the current flows away from the terminal end of the target well, whereby the magnitude of the ground current decreases exponentially with distance from the target well terminal end.

* * * * *

UNITED STATES PATENT AND TRADEMARK OFFICE

CERTIFICATE OF CORRECTION

PATENT NO. : 5,074,365

DATED : Dec. 24, 1991

INVENTOR(S) : Arthur F. Kuckes

It is certified that error appears in the above-identified patent and that said Letters Patent is hereby corrected as shown below:

Claim 7, column 11, line 39, "I" should be --$I_1$--.

Claim 15, column 12, line 43, "dulled" should be --drilled--.

Signed and Sealed this

Twenty-first Day of September, 1993

*Attest:*

*Attesting Officer*

BRUCE LEHMAN

*Commissioner of Patents and Trademarks*